US009963321B2

(12) United States Patent
Banno

(10) Patent No.: US 9,963,321 B2
(45) Date of Patent: May 8, 2018

(54) ELEVATOR DEVICE

(71) Applicant: Mitsubishi Electric Corporation, Chiyoda-ku (JP)

(72) Inventor: Hirokazu Banno, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 374 days.

(21) Appl. No.: 14/891,482

(22) PCT Filed: May 16, 2013

(86) PCT No.: PCT/JP2013/063662

§ 371 (c)(1),
(2) Date: Nov. 16, 2015

(87) PCT Pub. No.: WO2014/184926

PCT Pub. Date: Nov. 20, 2014

(65) Prior Publication Data

US 2016/0096707 A1 Apr. 7, 2016

(51) Int. Cl.
*B66B 1/34* (2006.01)
*B66B 1/28* (2006.01)
(Continued)

(52) U.S. Cl.
CPC ..... *B66B 1/28* (2013.01); *B66B 1/425* (2013.01); *B66B 9/00* (2013.01); *B66B 11/022* (2013.01)

(58) Field of Classification Search
CPC ..... B66B 1/28; B66B 11/022; B66B 1/425; B66B 9/00
(Continued)

(56) References Cited

U.S. PATENT DOCUMENTS 6,161,652 A * 12/2000 Kostka ..... B66B 1/42 187/291
6,334,511 B1 * 1/2002 Araki ..... B66B 1/30 187/380
(Continued)

FOREIGN PATENT DOCUMENTS

JP 2002-193570 A 7/2002
JP 2002-338154 A 11/2002
(Continued)

OTHER PUBLICATIONS

International Search Report dated Aug. 6, 2013 in PCT/JP2013/063662 filed May 16, 2013.
(Continued)

*Primary Examiner* — Anthony Salata
(74) *Attorney, Agent, or Firm* — Oblon, McClelland, Maier & Neustadt, L.L.P.

(57) ABSTRACT

An elevator device automatically setting a current value of an interval between upper and lower cars vertically movable inside a car frame, including: a moving mechanism vertically moving the cars; a memory storing a current interval between the cars; a car interval change quantity detector detecting a change quantity of the interval between the cars; an adjustment mechanism adjusting the interval between the cars based on the stored car interval and the detected change quantity of the interval; an initial car interval detector detecting that the interval between the cars has reached an initial car interval; and a learning mechanism causing the moving mechanism to vertically move the cars until the initial car interval detector detects that the interval between the cars has reached the initial car interval to learn the car interval when the car interval is not stored in the memory, which is then stored in the memory.

4 Claims, 3 Drawing Sheets

(51) Int. Cl.
*B66B 11/02* (2006.01)
*B66B 1/42* (2006.01)
*B66B 9/00* (2006.01)

(58) Field of Classification Search
USPC ..... 187/247, 249, 277, 284, 285, 391, 393, 187/401, 414
See application file for complete search history.

(56) References Cited

U.S. PATENT DOCUMENTS 6,336,522 B1 * 1/2002 Fujita ..... B66B 1/42 187/293
6,786,305 B2 * 9/2004 Kamimura ..... B66B 1/42 187/314
6,802,396 B2 * 10/2004 Naitoh ..... B66B 1/42 187/401
6,857,507 B2 * 2/2005 Gallati ..... B66B 1/425 187/284
7,090,056 B2 * 8/2006 Fujita ..... B66B 1/30 187/293
7,581,621 B2 * 9/2009 Kontturi ..... B66B 1/425 187/291
9,169,105 B2 * 10/2015 Urben ..... B66B 11/022
9,174,822 B2 * 11/2015 Cortona ..... B66B 1/42
9,643,818 B2 * 5/2017 Sen ..... B66B 11/022
9,809,419 B2 * 11/2017 Otsuka ..... B66B 1/36

FOREIGN PATENT DOCUMENTS

JP 2004-67286 A 3/2004
JP 2004-168530 A 6/2004
JP 2004-246298 A 9/2004
JP 2005-145696 A 6/2005
JP 2012-250829 A 12/2012
WO 2012/124067 A1 9/2012

OTHER PUBLICATIONS

English translation of International Preliminary Report on Patentability and Written Opinion dated Nov. 26, 2015 in PCT/JP2013/063662.
Combine Office Action and Search Report dated Jun. 28, 2016 in Chinese Patent Application No. 201380076595.2 (with English translation and English translation of category of cited documents).
Office Action dated Oct. 11, 2016 in Japanese Patent Application No. 2015-516836 (with partial English language translation).

* cited by examiner

Fig. 3

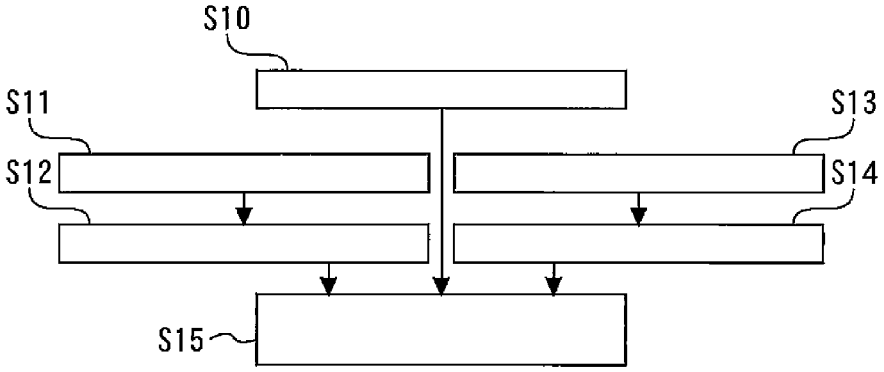

S10: ARITHMETICALLY OPERATE ADJUSTMENT QUANTITY OF CAR INTERVAL
S11: DETECT LOAD IN UPPER CAR
S12: ARITHMETICALLY OPERATE DEPRESSION OF UPPER CAR FLOOR
S13: DETECT LOAD IN LOWER CAR
S14: ARITHMETICALLY OPERATE DEPRESSION OF UPPER CAR FLOOR
S15: ARITHMETICALLY OPERATE TO COMPENSATE FOR ADJUSTMENT QUANTITY OF CAR INTERVAL

Fig. 4

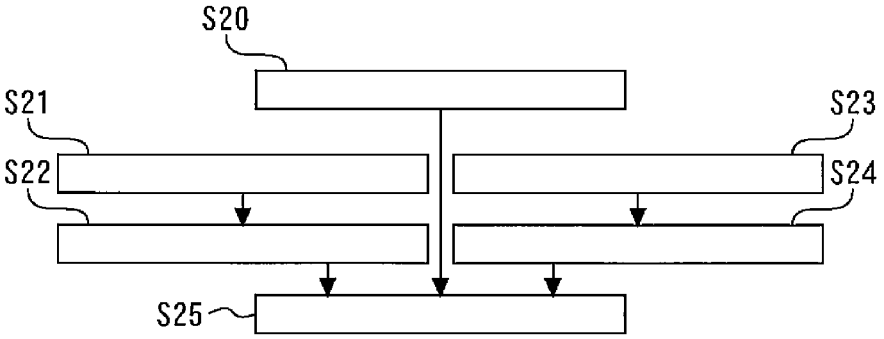

S20: ARITHMETICALLY OPERATE RELEVELING DISTANCE
S21: DETECT LOAD IN UPPER CAR
S22: ARITHMETICALLY OPERATE DEPRESSION OF UPPER CAR FLOOR
S23: DETECT LOAD IN LOWER CAR
S24: ARITHMETICALLY OPERATE DEPRESSION OF UPPER CAR FLOOR
S25: ARITHMETICALLY OPERATE TO COMPENSATE FOR RELEVELING DISTANCE

ELEVATOR DEVICE

TECHNICAL FIELD

The present invention relates to an elevator device.

BACKGROUND ART

A conventional elevator device is known which includes an interval adjustment device that adjusts an interval between an upper car and a lower car, and adjusts the interval between the upper car and the lower car in accordance with a floor interval between next stop floors (for example, see Patent Literature 1).

CITATION LIST

Patent Literature

Patent Literature 1: International Publication No. 2012/124067

Patent Literature 2: Japanese Patent Laid-Open No. 2002-338154

Patent Literature 3: Japanese Patent Laid-Open No. 2005-145696

Patent Literature 4: Japanese Patent Laid-Open No. 2012-250829

SUMMARY OF INVENTION

Technical Problem

However, in the conventional elevator device disclosed in Patent Literature 1, the interval adjustment device needs to grasp a current interval between the upper car and the lower car in order to adjust the interval between the upper car and the lower car. Thus, in installation of an elevator, an initial value of the interval between the upper car and the lower car needs to be set in the interval adjustment device, which is troublesome.

Also, for example, if information on the interval between the upper car and the lower car set in the interval adjustment device is lost due to a power failure, a precise interval between the upper car and the lower car cannot be grasped even if power is then restored. Thus, in an operation after restoration from the power failure, accuracy of adjustment of the interval between the upper car and the lower car may be significantly reduced, or the operation cannot be performed even after the restoration from the power failure.

The present invention is achieved to solve such problems, and provides an elevator device capable of automatically setting a current value of an interval between an upper car and a lower car, saving labor in installation of an elevator, and automatically restoring an operation while maintaining the same accuracy as before of adjustment of the interval between the upper car and the lower car even in case of loss of information.

Means for Solving the Problems

An elevator device according to the present invention includes: a car frame provided so as to be able to rise and descend in a shaft; an upper car vertically movably provided inside the car frame; a lower car vertically movably provided below the upper car inside the car frame; moving means configured to vertically move both the upper car and the lower car inside the car frame; memory means configured to store a car interval that is a current interval between both the cars; car interval change quantity detection means configured to detect a change quantity of the interval between both the cars; adjustment means configured to cause the moving means to vertically move both the cars to adjust the interval between both the cars based on the car interval stored in the memory means and the change quantity of the interval between both the cars detected by the car interval change quantity detection means; initial car interval detection means configured to detect that the interval between both the cars has reached a predetermined initial car interval; and learning means configured to, when the car interval is not stored in the memory means, cause the moving means to vertically move both the cars until the initial car interval detection means detects that the interval between both the cars has reached the initial car interval to learn the car interval, wherein the memory means stores the car interval learned by the learning means.

Advantageous Effect of Invention

The elevator device according to the present invention is advantageously capable of automatically setting a current value of an interval between an upper car and a lower car.

BRIEF DESCRIPTION OF THE DRAWINGS

FIG. 3 illustrates a car interval compensation arithmetic operation of the elevator device related to Embodiment 1 of the present invention.

FIG. 4 illustrates a releveling distance compensation arithmetic operation of the elevator device related to Embodiment 1 of the present invention.

DESCRIPTION OF EMBODIMENT

Embodiment 1

Figure 1:
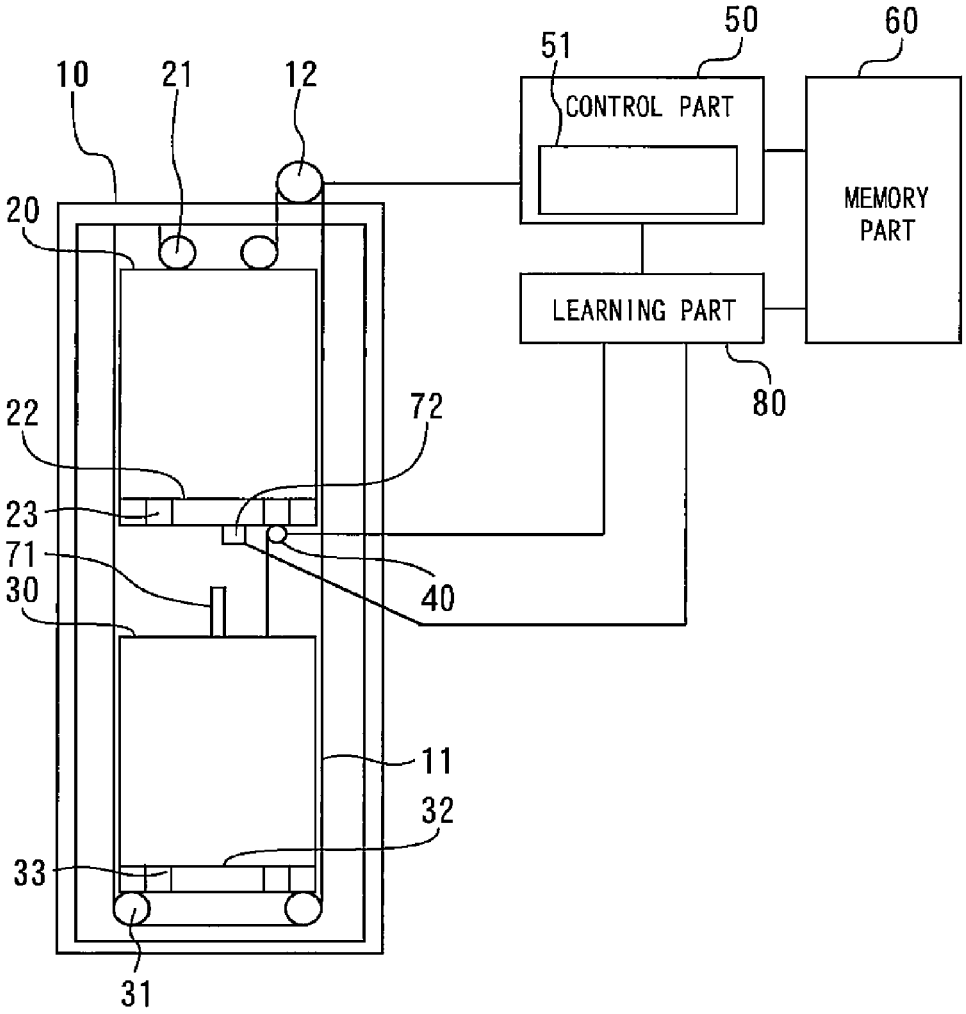
FIG. 1 is a schematic view of an overall configuration of an elevator device related to Embodiment 1 of the present invention.
Figure 2:
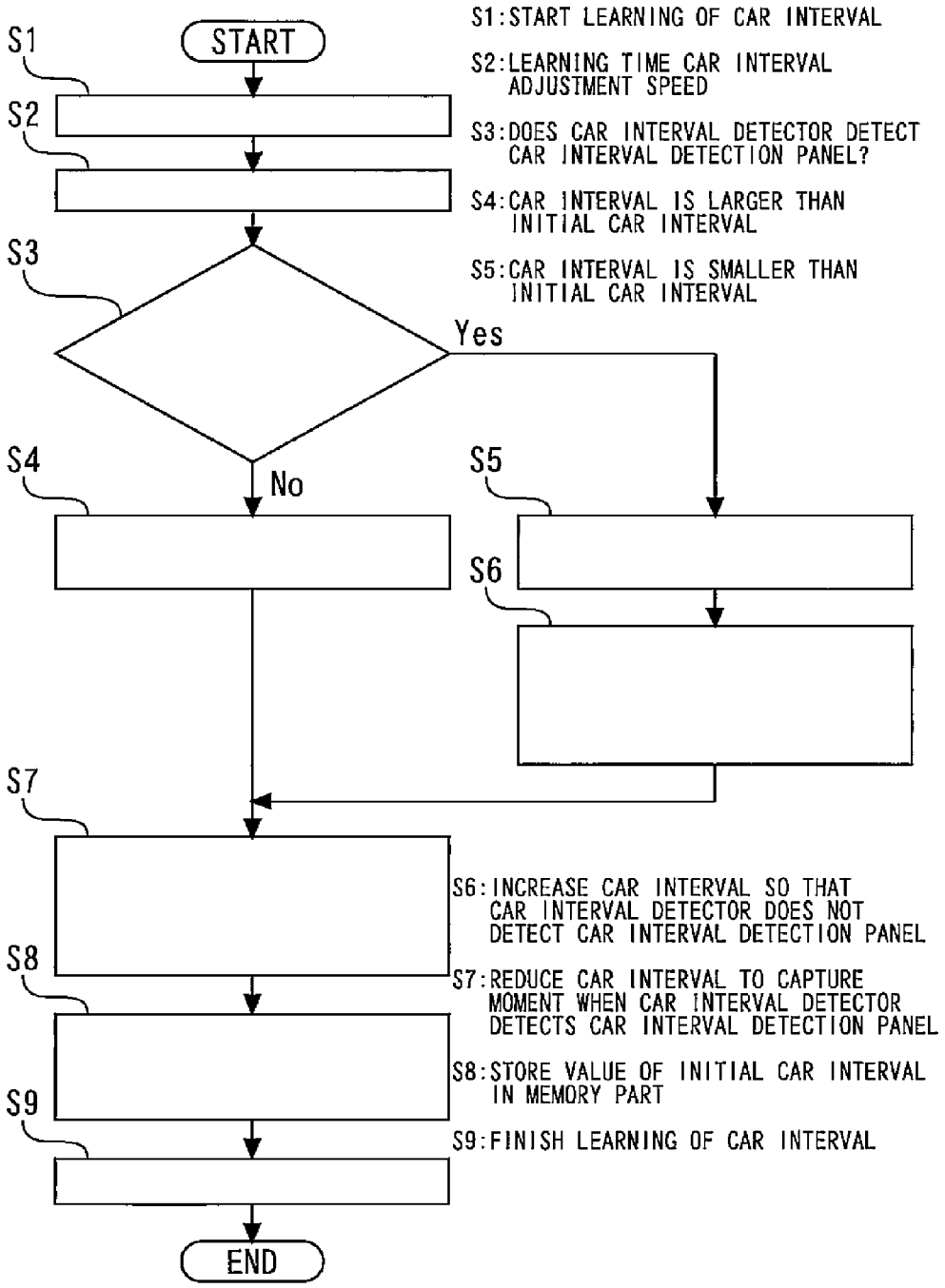
FIG. 2 is a flow diagram showing car interval learning of the elevator device related to Embodiment 1 of the present invention.

FIGS. 1 to 4 show Embodiment 1 of the present invention. FIG. 1 is a schematic view of an overall configuration of an elevator device, FIG. 2 is a flow diagram showing car interval learning of the elevator device, FIG. 3 illustrates a car interval compensation arithmetic operation of the elevator device, and FIG. 4 illustrates a releveling distance compensation arithmetic operation of the elevator device.

In FIG. 1, in a shaft of an elevator (not shown), a car frame 10 as a frame body is provided so as to be able to rise and descend. Inside the car frame 10, two elevator cars, an upper car 20 and a lower car 30 loaded with passengers or freight are vertically arranged and vertically movably provided. Specifically, the upper car 20 is vertically movably provided inside the car frame 10, and the lower car 30 is vertically movably provided below the upper car 20 inside the car frame 10. The elevator is a so-called double deck elevator.

An upper car suspension sheave 21 is mounted to an upper part of the upper car 20. A lower car suspension sheave 31 is mounted to a lower part of the lower car 30. Opposite ends of a rope 11 are locked to an upper inner side of the car frame 10. One end side of the rope 11 is wound around the upper car suspension sheave 21. The other end side of the rope 11 is wound around the lower car suspension sheave 31. A driving device 12 is provided on an upper outer side of the car frame 10. A middle part of the rope 11 is wound around a driving sheave of the driving device 12.

The driving device 12 constitutes moving means for vertically moving the upper car 20 and the lower car 30 inside the car frame 10. The driving device 12 operates to rotate the driving sheave, and thus the upper car 20 and the lower car 30 suspended by the rope 11 are vertically moved inside the car frame 10.

In this case, since the upper car 20 and the lower car 30 are suspended at opposite sides of one rope 11 with the driving device 12 therebetween, the upper car 20 and the lower car 30 are vertically moved synchronously in opposite directions. Thus, the driving device 12 vertically moves the upper car 20 and the lower car 30 to change a vertical interval (hereinafter referred to as a "car interval") between the upper car 20 and the lower car 30.

Specifically, if the driving sheave of the driving device 12 is rotated in one predetermined direction, the upper car 20 moves upward inside the car frame 10 and the lower car 30 moves downward inside the car frame 10, which can increase the car interval. If the driving sheave is rotated in a direction opposite to the one direction, the upper car 20 moves downward inside the car frame 10 and the lower car 30 moves upward inside the car frame 10, which can reduce the car interval.

A change quantity of the car interval is detected by a car interval change quantity detection device 40. The car interval change quantity detection device 40 is constituted by, for example, a device such as a linear encoder capable of detecting a change in linear distance. The car interval change quantity detection device 40 is provided between the upper car 20 and the lower car 30.

The car interval change quantity detection device 40 can detect a change quantity of the car interval when the driving device 12 moves the upper car 20 and the lower car 30, and also detect a change quantity of the car interval when the driving device 12 is not operated. A change in car interval when the driving device 12 is not operated is caused by, for example, a change in load on the car due to a user riding and getting out of the car.

The operation of the driving device 12 is controlled by a control part 50. The control part 50 controls the operation of the driving device 12 to vertically move the upper car 20 and the lower car 30 to adjust the car interval. A current car interval is stored in a memory part 60. For adjusting the car interval, the control part 50 determines a moving quantity of the upper car 20 and the lower car 30 from the current car interval stored in the memory part 60 and the change quantity of the car interval detected by the car interval change quantity detection device 40.

The car frame 10 rises and descends in the shaft while holding the upper car 20 and the lower car 30 therein by known means and a known method. Specifically, as an example, the car frame 10 and a counterweight (not shown) are suspended like a well bucket in the shaft by a main rope (not shown). A middle part of the main rope is wound around a traction machine provided at a top of the shaft. The traction machine drives the car frame 10 to rise and descend.

For stop at floors, the control part 50 moves the upper car 20 and the lower car 30 in the car frame 10 in the above described manner to adjust the interval between the upper car 20 and the lower car 30 in accordance with a distance between floors at which the upper car 20 and the lower car 30 stop respectively.

Specifically, the control part 50 constitutes adjustment means for causing the driving device 12 (moving means) to vertically move the upper car 20 and the lower car 30 to adjust the car interval based on the car interval stored in the memory part 60 and the change quantity of the car interval detected by the car interval change quantity detection device 40.

The adjustment of the car interval by the control part 50 as the adjustment means as described above is based on information on the car interval being previously stored in the memory part 60. However, if the information on the car interval is not stored in the memory part 60, such as immediately after installation of the elevator or when the information in the memory part 60 is lost due to a failure such as a power failure, the adjustment of the interval between the upper car 20 and the lower car 30 using the information in the memory part 60 cannot be performed.

Thus, the elevator device according to Embodiment 1 of the present invention includes a learning part 80. The learning part 80 learns a current car interval when a current car interval is not stored in the memory part 60 for a certain pair of stop floors. Next, a configuration used for learning by the learning part 80 will be described.

A car interval detection panel 71 is provided on one of the upper car 20 and the lower car 30. A car interval detector 72 is provided on the other of the upper car 20 and the lower car 30. The car interval detection panel 71 and the car interval detector 72 constitute initial car interval detection means for detecting that the interval between the upper car 20 and the lower car 30 has reached a predetermined initial car interval.

The car interval detection panel 71 is a plate-like member provided to protrude from one to the other of the cars. The car interval detector 72 detects at least a front end on the other side of the car interval detection panel 71. With such a configuration, it is detected that the car interval has reached the initial car interval when a detection condition of the car interval detection panel 71 by the car interval detector 72 changes as the interval between the upper car 20 and the lower car 30 is changed.

When the current car interval is not stored in the memory part 60, the learning part 80 causes the moving means (driving device 12) to vertically move the upper car 20 and the lower car 30 until the initial car interval detection means (the car interval detection panel 71 and the car interval detector 72) detect that the car interval has reached the initial car interval. In this case, the moving means reduces a moving speed of the upper car 20 and the lower car 30 as compared to that in a normal time. The normal time herein is a time for adjusting the interval between the upper car 20 and the lower car 30 based on the car interval stored in the memory part 60.

Next, the learning part 80 stops movement of the upper car 20 and the lower car by the moving means when the initial car interval detection means detects that the car interval has reached the initial car interval. Then, the learning part 80 learns that the current car interval is the initial car interval. A value of the car interval learned by the learning part 80, that is, a value of the initial car interval is stored in the memory part 60 as the current car interval.

As such, after learning of the car interval by the learning part 80, the car interval change quantity detection device 40 can detect a change quantity of the car interval with reference to the car interval stored in the memory part 60, that is, the initial car interval.

Next, with reference to a flow diagram in FIG. 2, learning of the car interval by the learning part 80 will be described in detail. First, when it is confirmed that the current car interval is not stored in the memory part 60, in step S1, the learning part 80 starts learning of the car interval. When learning of the car interval is started, in step S2, a moving speed of the upper car 20 and the lower car 30 by the driving device 12 is set to a learning time car interval adjustment speed lower than that in a normal time.

In subsequent step S3, the learning part 80 confirms whether or not the car interval detector 72 detects the car interval detection panel 71. When the car interval detector 72 does not detect the car interval detection panel 71, the process proceeds to step S4. In step S4, the current car interval is larger than the initial car interval. Then, the process directly proceeds to step S7.

On the other hand, in step S3, when the car interval detector 72 detects the car interval detection panel 71, the process proceeds to step S5. In step S5, the current car interval is smaller than the initial car interval. Then, the process proceeds to step S6, and the control part 50 causes the driving device 12 to move the upper car 20 and the lower car 30 until the car interval detector 72 does not detect the car interval detection panel 71. As such, the current car interval is once increased to be larger than the initial car interval, and then the process proceeds to step S7.

In step S7, the learning part 80 causes the driving device 12 to move the upper car 20 and the lower car 30 so as to reduce the car interval until the car interval detector 72 detects the car interval detection panel 71. Then, when the car interval detector 72 detects the car interval detection panel 71, the movement of the upper car 20 and the lower car 30 is stopped.

At finish of step S7, the current car interval is the initial car interval. Then, in next step S8, the memory part 60 stores the initial car interval as the current car interval. The initial car interval is predetermined and known.

Then, the process proceeds to step S9, and the learning part 80 finishes learning of the car interval. As such, a series of car interval learning operations is finished.

After learning of the car interval as described above, the car interval change quantity detection device 40 can accurately detect the change quantity of the interval between the upper car 20 and the lower car 30 with reference to the initial car interval stored in the memory part 60. Thus, the control part 50 and the driving device 12 can accurately adjust the car interval using a detection result of the car interval change quantity detection device 40.

Car floors of the upper car 20 and the lower car 30 are supported by elastic bodies. Specifically, as shown in FIG. 1, an upper car floor 22 supported by an elastic body is provided in a cab of the upper car 20. A lower car floor 32 supported by an elastic body is provided in a cab of the lower car 30.

Under the upper car floor 22, an upper car load detection device 23 that detects a load on the upper car floor 22 is provided. Similarly, for the lower car 30, under the lower car floor 32, a lower car load detection device 33 that detects a load on the lower car floor 32 is provided.

The upper car floor 22 and the lower car floor 32 are depressed depending on loads placed in the cabs of the upper car 20 and lower car 30. In order to accurately align the car floors with hall floors of stop floors to accommodate such depression of the car floors at stop of the upper car 20 and/or the lower car 30, the control part 50 includes a car interval compensation arithmetic operation part 51.

With reference to FIG. 3, a compensation arithmetic operation of the car interval compensation arithmetic operation part 51 will be described. First, in step S10, when the upper car 20 and/or the lower car 30 stops at a stop floor, the control part 50 arithmetically operates an adjustment quantity Cfd of the car interval in accordance with the position of the stop floor.

In step S11, the upper car load detection device 23 detects a load placed in the cab of the upper car 20. Then, in subsequent step S12, the car interval compensation arithmetic operation part 51 arithmetically operates a depression quantity Fu of the upper car floor 22 based on the load detected in step S11.

Also, similarly, for the lower car 30, in step S13, the lower car load detection device 33 detects a load placed in the cab of the lower car 30. Then, in subsequent step S14, the car interval compensation arithmetic operation part 51 arithmetically operates a depression quantity Fl of the lower car floor 32 based on the load detected in step S13.

In step S15, the car interval compensation arithmetic operation part 51 performs a compensation arithmetic operation for compensating for the adjustment quantity Cfd of the car interval arithmetically operated in step S10 with the depression quantity Fu of the upper car floor 22 arithmetically operated in step S12 and the depression quantity Fl of the lower car floor 32 arithmetically operated in step S14. The compensation arithmetic operation is specifically performed based on Expression (1) below.

$$\text{(Adjustment quantity of car interval after compensation)} = Cfd - Fu + Fl \quad (1)$$

The control part 50 causes the driving device 12 to move the upper car 20 and the lower car 30 to adjust the car interval based on the compensated adjustment quantity of the car interval thus obtained. The car interval thus adjusted is compensated for in view of the depression quantity of the upper car floor 22 and the depression quantity of the lower car floor 32. This allows more accurate leveling.

If the car interval adjustment using the car interval compensation arithmetic operation part 51 cannot accommodate misalignment of the floor due to depression of the car floor, releveling for adjusting the position of the car frame 10 may be performed to minimize misalignment between the upper car floor 22 and the lower car floor 32 and the hall floors of the respective stop floors.

As described above, a traction machine causes the car frame 10 to rise and descend. An operation of the traction machine is controlled by a control panel (not shown). The control panel performs a compensation arithmetic operation of a releveling distance as shown in FIG. 4. First in step S20, the control panel arithmetically operates a releveling distance of the car frame 10. The arithmetic operation of the releveling distance may be achieved by known means and a known method.

In step S21, the upper car load detection device 23 detects a load placed in the cab of the upper car 20. Then, in subsequent step S22, the car interval compensation arithmetic operation part 51 arithmetically operates the depression quantity Fu of the upper car floor 22 based on the load detected in step S21.

Similarly, for the lower car 30, in step S23, the lower car load detection device 33 detects a load placed in the cab of the lower car 30. Then, in subsequent step S24, the car interval compensation arithmetic operation part 51 arithmetically operates the depression quantity Fl of the lower car floor 32 based on the load detected in step S23.

In step S25, the control panel performs a compensation arithmetic operation for compensating for the releveling distance arithmetically operated in step S20 with the depression quantity Fu of the upper car floor 22 arithmetically operated in step S22 and the depression quantity Fl of the lower car floor 32 arithmetically operated in step S24. A compensation quantity in this case is specifically obtained based on Expression (2) below.

$$(\text{Compensation quantity of releveling distance})=(Fu+Fl)/2 \quad (2)$$

As such, the releveling distance of the car frame 10 can be compensated for in view of the depression quantity of the upper car floor 22 and the depression quantity of the lower car floor 32 to minimize misalignment between the upper car floor 22 and the lower car floor 32 and the hall floors of the respective stop floors.

In the elevator device configured as described above, when the car interval is not stored in the memory part 60, the learning part 80 moves the upper car 20 and the lower car 30 until the car interval detection panel 71 and the car interval detector 72 as the initial car interval detection means detect that the interval between the upper car 20 and the lower car 30 has reached the initial car interval.

When it is detected that the interval between the upper car 20 and the lower car 30 has reached the initial car interval, the initial car interval is stored as the current car interval in the memory part 60. Thus, in the operation thereafter, the car interval can be adjusted based on the precise current car interval.

Thus, the current value of the interval between the upper car and the lower car can be automatically set to save labor in installation of the elevator. Also, even if the information stored in the memory part 60 is lost due to a power failure or the like, a precise car interval can be again learned to automatically restore the operation while maintaining the same accuracy as before of adjustment of the interval between the upper car and the lower car.

Also, the driving device 12 as the moving means reduces the moving speed of the upper car 20 and the lower car 30 as compared to that in the normal time in learning by the learning part 0. This increases detection accuracy of the initial car interval by the car interval detection panel 71 and the car interval detector 72 as the initial car interval detection means, and allows more precise learning of the car interval.

Also, when the car interval is smaller than the initial car interval, the learning part 0 causes the driving device 12 as the moving means to once increase the car interval to be larger than the initial car interval and then reduce the car interval. This allows precise learning of the car interval whether the current car interval is larger or smaller than the initial car interval.

Further, the control part 50 as the adjustment means includes the car interval compensation arithmetic operation part 51 as the compensation means for compensating for the adjustment quantity of the car interval. The car interval compensation arithmetic operation part 51 compensates for the adjustment quantity of the car interval with the depression quantities of the car floors of the upper car 20 and the lower car 30 obtained based on the loads in the cabs detected by the upper car load detection device 23 and the lower car load detection device 33 as the load detection means.

Thus, even if the number of passengers in the cab of the upper car 20 and/or the lower car 30 changes, each car floor can be accurately aligned with the hall floor in view of the depression quantity of the car floor due to a change in load caused by the change in the number of passengers.

In addition, the car interval change quantity detection device 40 that can also detect the change quantity of the car interval when the driving device 12 is not operated is used, thereby allowing the change quantity of the car interval caused by the change in the number of passengers to be detected. This allows the car interval to be adjusted in view of the change in car interval caused by the change in the number of passengers.

INDUSTRIAL APPLICABILITY

The present invention may be applied to an elevator device in which a plurality of cars are vertically arrange in a car frame, and that includes means for adjusting an interval between the cars.

DESCRIPTION OF SYMBOLS

10 car frame, 11 rope, 12 driving device, 20 upper car, 21 upper car suspension sheave, 22 upper car floor, 23 upper car load detection device, 30 lower car, 31 lower car suspension sheave, 32 lower car floor, 33 lower car load detection device, 40 car interval change quantity detection device, 50 control part, 51 car interval compensation arithmetic operation part, 60 memory part, 71 car interval detection panel, 72 car interval detector, 80 learning part

The invention claimed is:

1. An elevator device comprising:

a car frame provided so as to be able to rise and descend in a shaft;

an upper car vertically movably provided inside the car frame;

a lower car vertically movably provided below the upper car inside the car frame;

a driving device configured to vertically move both the upper car and the lower car inside the car frame;

a memory configured to store a car interval that is a current interval between both the cars;

a car interval change quantity detection device configured to detect a change quantity of the interval between both the cars;

a control part configured to cause the driving device to vertically move both the cars to adjust the interval between both the cars based on the car interval stored in the memory and the change quantity of the interval between both the cars detected by the car interval change quantity detection device;

initial car interval detection means configured to detect that the interval between both the cars has reached a predetermined initial car interval; and a learning part configured to, when the car interval is not stored in the memory, cause the driving device to vertically move both the cars until the initial car interval detection means detects that the interval between both the cars has reached the initial car interval to learn the car interval, wherein the memory stores the car interval learned by the learning part, wherein the driving device reduces a moving speed of both the cars inside the car frame as compared to that in a normal time in learning by the learning part.

2. The elevator device according to claim 1, wherein the initial car interval detection means includes:

a detection panel provided to protrude from one to the other of both the cars; and a detector provided on the other of both the cars, the detector detecting the detection panel.

3. The elevator device according to claim 1, wherein when the interval between both the cars is smaller than the initial car interval, the learning part causes the driving device to once increase the interval between both the cars to be larger than the initial car interval and then reduce the interval between both the cars.

4. The elevator device according to claim 1, further comprising a load detection device configured to detect a load placed in a cab of each of both the cars, wherein the control part includes a compensation arithmetic operation part configured to compensate for an adjustment quantity of the interval between both the cars using a depression quantity of a car floor of each of both the cars obtained based on the load detected by the load detection device.

* * * * *